US005297305A

United States Patent [19]

Williams

[11] Patent Number: 5,297,305

[45] Date of Patent: Mar. 29, 1994

[54] CHANGING TABLE CONVERTIBLE INTO A YOUTH BED AND PLAY TABLE

[75] Inventor: Keith A. Williams, Salem, Ind.

[73] Assignee: Child Craft Industries, Inc., Salem, Ind.

[21] Appl. No.: 913,142

[22] Filed: Jul. 14, 1992

[51] Int. Cl.[5] ..... A47D 11/00

[52] U.S. Cl. ..... 5/655; 5/2.1; 5/93.2; 108/19; 108/157

[58] Field of Search ..... 5/655, 785, 201, 2.1, 5/3, 932, 131, 132; 108/11, 18, 19, 27, 157, 153

[56] References Cited

U.S. PATENT DOCUMENTS

| | | | |
|---|---|---|---|
| 252,730 | 1/1882 | Burr . | |
| 259,189 | 6/1882 | McMaster . | |
| 704,443 | 7/1902 | Doran . | |
| 797,852 | 8/1905 | Hayden . | |
| 1,453,241 | 4/1923 | Duffield | 5/285 |
| 1,487,341 | 3/1924 | Lange . | |
| 1,881,095 | 10/1932 | Penrose | 5/2.1 |
| 2,287,452 | 6/1942 | Rossom . | |
| 2,363,599 | 11/1944 | Kurth et al. . | |
| 2,570,609 | 10/1951 | Taylor, Jr. . | |
| 2,787,007 | 4/1957 | Erdkamp | 5/2.1 |
| 3,080,573 | 3/1963 | Marsman | 5/2.1 |
| 3,239,270 | 3/1966 | Milne . | |
| 3,427,666 | 2/1969 | Saxe | 5/2.1 |
| 3,427,669 | 2/1969 | Swenson . | |
| 3,841,727 | 10/1974 | Peng | 5/2.1 |
| 3,885,845 | 5/1975 | Krieks . | |
| 4,361,919 | 12/1982 | Hull . | |
| 4,940,149 | 7/1990 | Vineis | 5/131 |
| 5,022,721 | 6/1991 | Melgers . | |
| 5,067,183 | 11/1991 | Urquiola | 5/2.1 |

FOREIGN PATENT DOCUMENTS

| | | | |
|---|---|---|---|
| 227161 | 7/1978 | European Pat. Off. | 5/2.1 |
| 2653249 | 6/1978 | Fed. Rep. of Germany | 5/2.1 |

*Primary Examiner*—Peter M. Cuomo
*Assistant Examiner*—Flemming Saether
*Attorney, Agent, or Firm*—Barnes & Thornburg

[57] ABSTRACT

An article of furniture is convertible from an infant changing table to a youth bed frame and play table. The changing table table comprises an upper portion, including the youth bed frame headboard and footboard, sitting on a play table frame. A plurality of horizontal platforms are included for supporting an infant for changing diapers, or for holding other items. When converted to a youth bed frame and play table configuration, the headboard and footboard are connected by separate mattress support rails, included in the invention, to complete the bed frame. A separate table top, included in the invention, is coupled to the table frame to complete the play table.

7 Claims, 3 Drawing Sheets

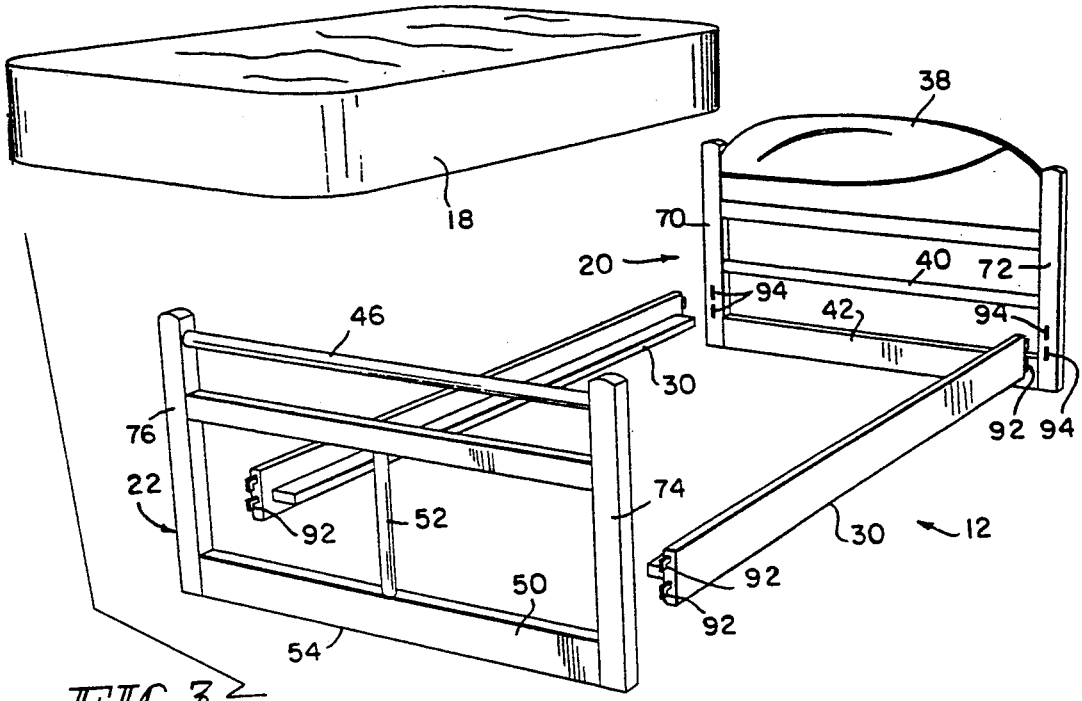
FIG. 3
FIG. 4
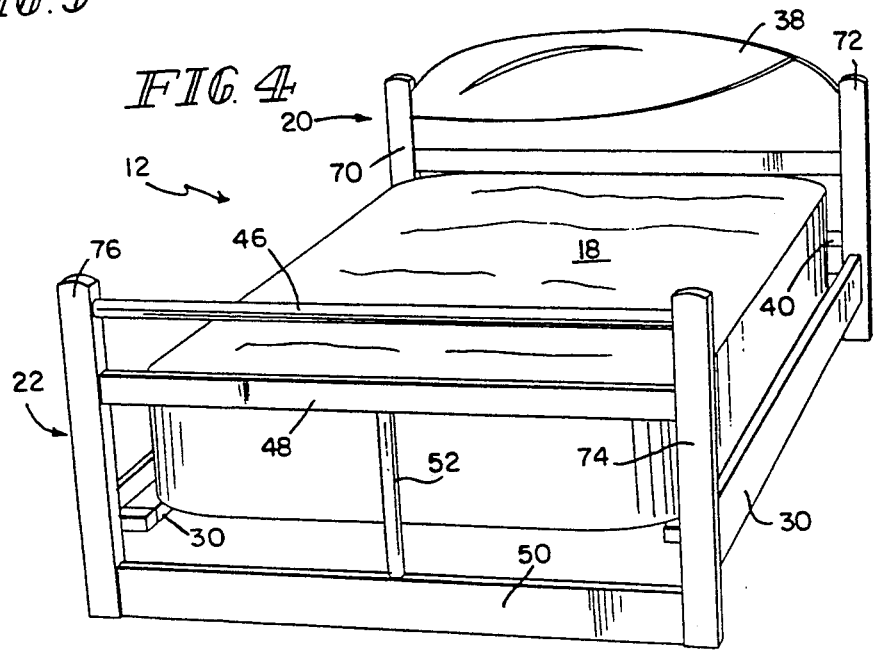

CHANGING TABLE CONVERTIBLE INTO A YOUTH BED AND PLAY TABLE

BACKGROUND AND SUMMARY OF THE INVENTION

This invention relates to furniture of the type used by infants and youths, and in particular to furniture that is convertible from an infant changing table to a youth bed frame and play table combination.

As an infant grows, it outgrows the need for changing table and crib, while developing an increasing need for a youth bed and a play table. At some point, a decision must be made as to whether to dispose of the changing table or to store it. Disposal would generally involve some economic loss due to depreciation and wear and tear. Storage, on the other hand, requires space that might be put to better use. At the same time, a growing child needs a play table for toys and games. Therefore, it would be desirable to have a piece of convertible furniture would that convert from a changing table to a youth bed frame and play table. Such a piece of convertible furniture would obviate the need for disposal and thereby provide an economic benefit and also solve the storage problem. It would also replace an unneeded changing table with two needed pieces of furniture for a child without added cost.

Convertible furniture is known. See, for example, U.S. Pat. No. 2,570,609 to Taylor; U.S. Pat. No. 2,363,599 to Kurth et al.; U.S. Pat. No. 3,427,669 to Swenson; U.S. Pat. No. 704,443 to Doran; U.S. Pat. No. 797,852 to Hayden; U.S. Pat. No. 1,487,341 to Lang; U.S. Pat. No. 2,287,452 to Rossom; U.S. Pat. No. 2,787,007 to Erdkamp; U.S. Pat. No. 3,239,270 to Milne; U.S. Pat. No. 4,361,919 to Hall; U.S. Pat. No. 259,189 to McMaster; and U.S. Pat. No. 252,730 to Burr.

Conventional convertible furniture typically changes a crib to a table or changes a crib to a youth bed frame. That is, the typical convertible furniture only satisfies the need for using a piece of infant furniture to form either a youth bed frame or a play table, but not both. Conventional convertible furniture still requires the outlay of additional expense in order to satisfy the needs of a growing child. Therefore, an infant changing table that converts into both a youth bed frame and play table would be an improvement over conventional convertible furniture.

According to the present invention, an article of furniture which is convertible from an infant changing table to a youth bed frame and play table comprises a plurality of horizontally disposed, vertically registered platforms, the top platform of which serves as a child supporting top for the changing table. It further includes first means for supporting the platforms in elevated space-apart relation, wherein the first means comprises an upper portion which is removable to form a portion of the youth bed frame and a lower portion to form a base for the play table. It further comprises side rails for enclosing the platforms, wherein the side rails means are adapted to be coupled to the platforms and to the first supporting means. The article of furniture further comprises mattress support rails for supporting the mattress wherein the mattress support rails are adapted to be coupled to the upper portion of the first supporting means to provide the youth bed frame, and a table top adapted to be coupled to the lower portion of the first supporting means to provide the play table.

In a preferred embodiment, a convertible furniture kit has component parts capable of being assembled to form an infant changing table or youth bed frame and play table. The kit comprises a base support providing a lower table frame and end walls adapted to be mounted on the base support to provide a back and a front for the changing table. It further comprises a plurality of side rails adapted to be coupled to the base support or coupled to the end walls, and a plurality of platforms adapted to be coupled to the side rails with a top one of the platforms providing a child supporting top for the changing table. It also has a pair of mattress support rails adapted to be coupled to the end walls to provide the youth bed frame, and a table top adapted to be coupled to the base support to provide the play table.

Additional objects, features, and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which:

FIG. 3 is an exploded perspective view of a youth bed frame;

FIG. 4 is a perspective view of an assembled youth bed frame with mattress (not part of the invention);

DETAILED DESCRIPTION OF THE DRAWINGS

Figure 1:
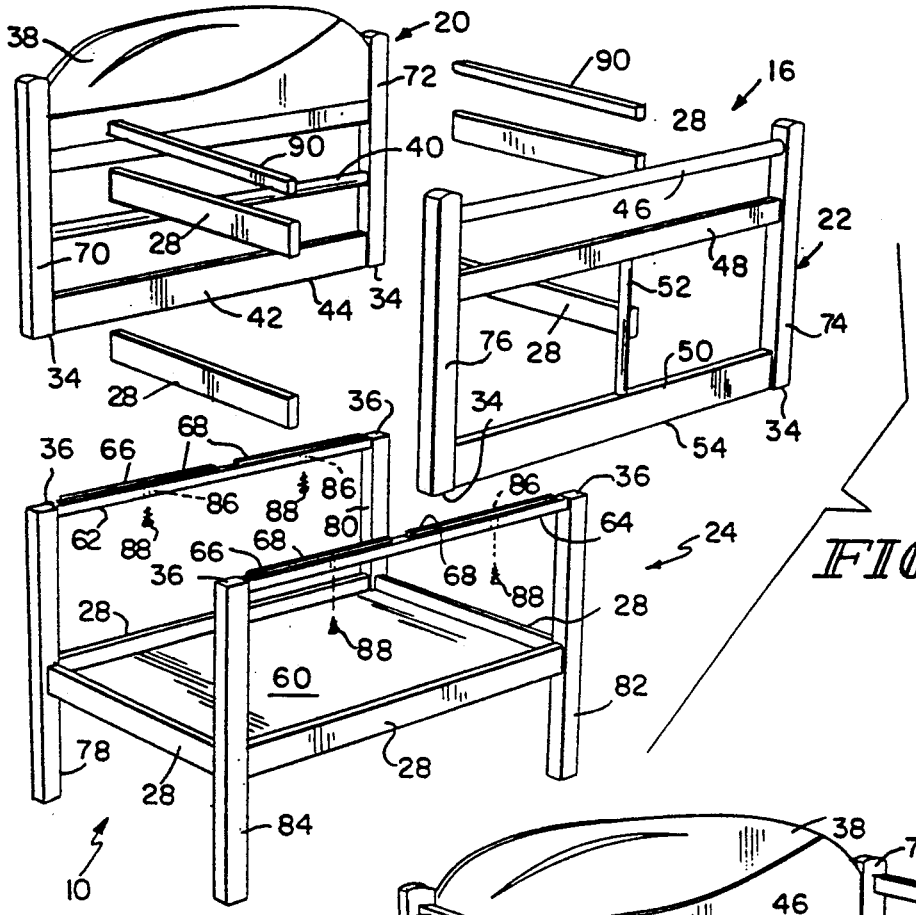
FIG. 1 is an exploded perspective view of a changing table.
Figure 2:
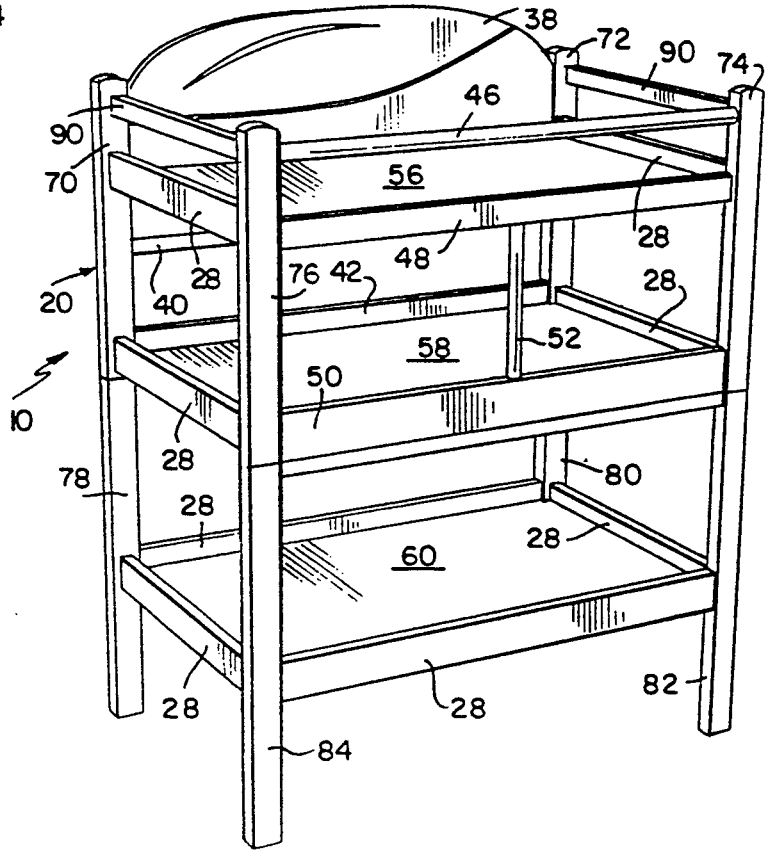
FIG. 2 is a perspective view of an assembled changing table.
Figure 5:
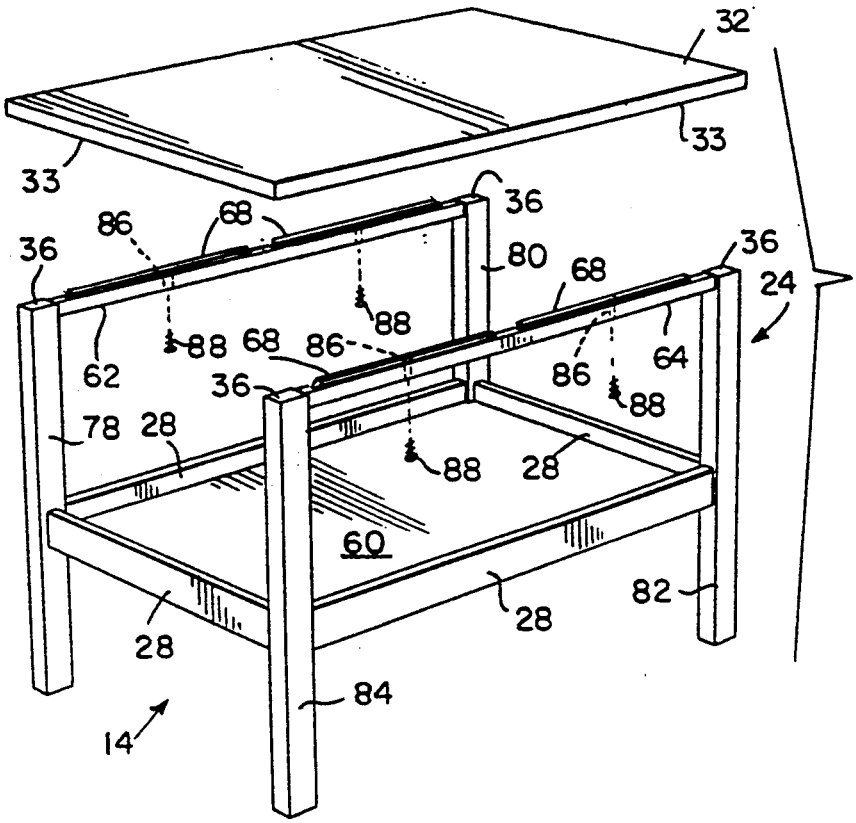
FIG. 5 is an exploded perspective view of a play table.
Figure 6:
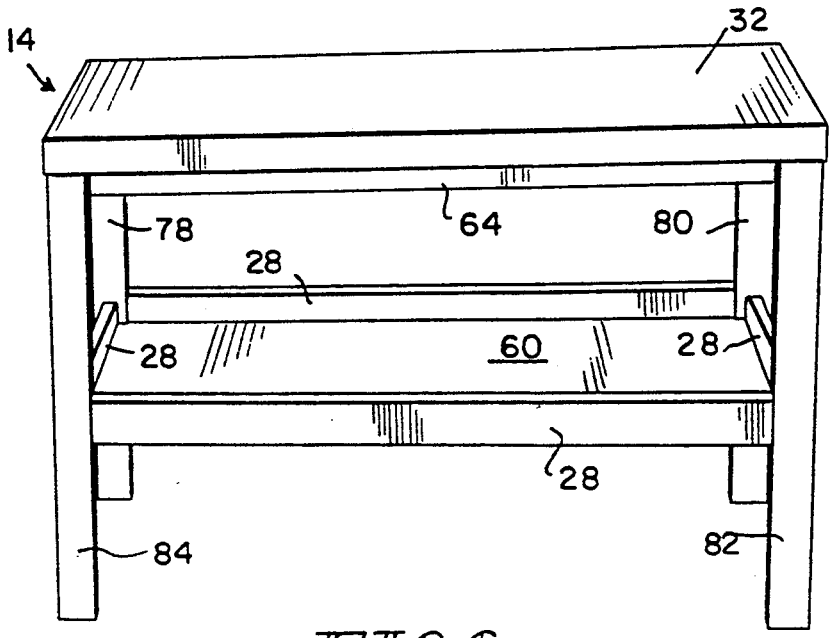
FIG. 6 is a perspective view of an assembled play table.

A convertible article of furniture constructed according to the present invention includes a changing table 10, shown illustratively in FIGS. 1 and 2, or a youth bed frame 12, shown illustratively in FIGS. 3 and 4, and a play table 14, shown illustratively in FIGS. 5 and 6. Mattress 18, shown in FIGS. 3 and 4, is not a part of this invention but is shown for completeness.

The article of furniture is preferably made of wood, but other materials, such as steel, plastic, or composites, can be used in the construction. Furthermore, the various parts of the invention are joined together using standard and well known methods. These methods can include, but are not limited to, the use of mortise and tenons joints, dowels, nails, screws, glue, or the like.

The changing table 10 comprises an upper portion 16 and a table frame 24. The upper portion 16 has a headboard 20, a footboard 22, with side rails 28 and 90 and platforms 56 and 58 disposed therebetween.

The headboard 20 includes a pair of vertically oriented spaced-apart upper corner posts 70 and 72 (FIG. 1). A top headboard rail 38, an intermediate headboard rail 40, and a bottom headboard rail 42 are horizontally oriented and vertically spaced to extend between the upper corner posts 70 and 72 in the illustrated parallel spaced-apart relation to each other. The bottom headboard rail 42 is positioned so that a bottom surface 44 of the headboard rail 42 lies coplanar with the bottom surface 34 of the corner posts 70 and 72. In preferred embodiments, a mortise (not shown) is cut into the bottom surface 44 of the headboard rail 42.

The footboard 22 comprises a pair of vertically oriented spaced-apart upper corner posts 74 and 76. A top footboard rail 46, an intermediate footboard rail 48 and a bottom footboard rail 50 are horizontally oriented and vertically spaced disposed between the upper corner posts 74 and 76 in parallel spaced-apart relation to each other. The bottom footboard rail 50 is positioned so that the bottom surface 54 of the footboard rail 50 is coplanar with the bottom surface 34 of the upper corner posts 74 and 76. In preferred embodiments, a mortise (not shown) is cut into the bottom surface 54 of the footboard rail 50.

A top platform 56 (not shown in FIG. 1) and an intermediate platform 58 (not shown in FIG. 1) are horizontally disposed between the headboard 20 and the footboard 22 in parallel spaced-apart relation to each other. The top platform 56 serves as a child support platform when the article of furniture is in the changing table configuration.

Side rails 28 are attached to side edges of the platforms 56 and 58 and disposed between the upper corner posts 70 and 76 and between corner posts 72 and 74. The side rails 28, the upper corner posts 70, 72, 74, and 76, the bottom headboard rail 44, and the bottom footboard rail 50 cooperate to form a perimetrally continuous, vertically extending ledge around the intermediate platform 58. In like manner, side rails 28, upper corner posts 70, 72, 74, and 76, the top headboard rail 38, and the intermediate footboard rail 48 cooperate to form a perimetrally continuous, vertically extending ledge around the top platform 56. The vertical ledges serve to retain items placed on the platforms 56 and 58. A pair of upper side rails 90 are horizontally disposed between the upper corner posts 70 and 76 and between corner posts 72 and 74. The upper side rails 90, the top headboard rail 38, and the top footboard rail 46 cooperate to form an enclosure around the top platform 56.

The table frame 24 comprises four vertically oriented lower corner posts 78, 80, 82 and 84 in parallel spaced-apart relation to each other. A horizontally disposed bottom platform 60 is positioned so as to have one of the corner posts 78, 80, 82 and 84 at each corner of the bottom platform 60. Four side rails 28 are attached to the edges of the platform 60 and to the lower corner posts 78, 80, 82 and 84. The side rails 28 and the lower corner posts 78, 80, 82 and 84 cooperate to form a perimetrally continuous, vertically extending ledge around the bottom platform 60. A first upper table frame rail 62 is horizontally disposed between corner posts 78 and 80 and a second upper table frame rail 64 is disposed between corner posts 82 and 84. The rails 62 and 64 are positioned so as to have the upper surfaces 66 of the rails 62 and 64 coplanar with the upper surfaces 36 of the lower corner posts 78, 80, 82 and 84. In preferred embodiments, a pair of tenons 68 extend above the upper surface 66 of each rail 62 and 64. Vertical screwholes are formed in the rails 62 and 64 and extend through the tenons 68 formed thereon.

The combination of the headboard 20, footboard 22, top platform 56, intermediate platform 58, and attached side rails 28 and 90 form the upper portion 16 of the changing table 10. The changing table 10 is completed by mounting the upper portion 16 to the table frame 24. In preferred embodiments, the tenons 68 engage the mortise (not shown) formed in the bottom surfaces 44 and 54 of the headboard rail 42 and the footboard rail 50, respectively. Screws 88 are inserted into the screwholes 86 and engage the bottom headboard rail 42 and bottom footboard rail 50. When mounted, the upper corner posts 70, 72, 74, and 76 align with and rest on top of lower corner posts 78, 80, 82, and 84, respectively. The bottom surface 44 of the bottom headboard rail 42 lies adjacent to the top surface 66 of the upper table frame rail 62 and the bottom surface 54 of the bottom footboard rail 50 lies adjacent to the top surface 66 of the upper table frame rail 64. The tenons 68 formed on the upper table frame rails 62 and 64 engage the mortises (not shown) formed in the headboard rail 42 and the footboard rail 50.

The play table is formed by attaching a horizontal table top 32 to the upper surface 66 of the upper table frame rails 62 and 64 as shown illustratively in FIGS. 5 and 6. In preferred embodiments, a plurality of mortises (not shown) are cut into the bottom surface 33 of the table top 32. The mortises (not shown) are positioned to engage the tenons 68 formed on the upper table frame rails 62 and 64. Screws 88 are inserted into screwholes 86 and engage the table top 32, thereby holding the table top 32 in place atop the table frame 24.

The youth bed frame 12 is formed by attaching the mattress support rails 30 to, and disposing them in parallel relation between, upper corner posts 70 and 76 and between the corner posts 72 and 74 as shown illustratively in FIGS. 3 and 4. In preferred embodiments, engagement hooks 92 are coupled to the ends of the mattress support rails 30 as shown illustratively in FIG. 3. The engagement hooks 92 fit into engagement slots 94 formed in the upper corner posts 70, 72, 74, and 76 (slots only shown in posts 70 and 72 in FIG. 3). Retainer pins (not shown) are positioned inside the upper corner posts 70, 72, 74, and 76 so as to be perpendicular to the planes of the slots 94. The engagement hooks 92 engage the retaining pins (not shown) to removably couple the mattress rails 30 to the corner posts 70, 72, 74, and 76.

A vertical mattress retention rail 52 is also attached to the foot board 22 when converting from the changing table configuration to the youth bed frame configuration. The mattress retention rail 52 is attached to the intermediate foot board rail 48 and the bottom foot board rail 50 and is vertically disposed in parallel relation between the corner posts 74 and 76. The mattress 18 (not a part of this invention) is then set between the mattress support rails 30 and between the head board 20 and the foot board 22.

Although the invention has been described in detail with reference to certain preferred embodiments, variations and modifications exist within the scope and spirit of the invention as described and defined in the following claims.

I claim:

1. A convertible furniture kit having component parts capable of being assembled to form an infant changing table or a youth bed frame and play table, the article comprising;

a plurality of horizontally disposed, vertically registered platforms, the top platform of which serves as a child supporting top for said changing table in a first configuration, first means for supporting said platforms in elevated, spaced-apart relation, said first means comprising an upper portion which is removable to form a portion of said youth bed frame and a lower portion to form a base for said play table, said youth bed frame and said play table forming a second configuration, side rails for enclosing the platforms, said side rails being adapted to be coupled to the platforms and the first supporting means, mattress support rails for supporting a mattress, said mattress support rails being adapted to be coupled to the upper portion of said first supporting means to provide said youth bed frame, and a table top adapted to be coupled to the lower portion of said first supporting means to provide said play table.

2. The kit of claim 1, wherein the first supporting means further comprises end walls.

3. A convertible furniture kit having component parts capable of being assembled to form an infant changing table or youth bed frame and play table, the kit comprising;

a base support providing a lower table frame, end walls adapted to be mounted on the base support to provide a back and a front for said changing table, the changing table forming a first configuration, a plurality of side rails adapted to be coupled to the base support and the end walls, a plurality of platforms adapted to be coupled to the side rails with a top one of said platforms providing a child supporting top for said changing table, a pair of mattress support rails adapted to be coupled to the end walls to provide said youth bed frame, and a table top to be coupled to the base support to provide said play table, said youth bed frame and said play table forming a second configuration.

4. The furniture kit of claim 3, wherein the first configuration comprises the end walls removably coupled to the base support and at least said top platform disposed intermediate the end walls, and a plurality of side rails removably coupled to said top platform and to the end walls.

5. The furniture kit of claim 3, wherein the youth bed frame comprises the mattress support rails removably coupled to the end walls.

6. The furniture kit of claim 3, wherein the base support comprises a lower platform disposed between a plurality of vertical legs and a plurality of side rails coupled to the vertical legs and to the lower platform so as to form an upwardly projecting ledge around the perimeter of the lower platform.

7. A convertible furniture kit having component parts capable of being assembled to form an infant changing table or a youth bed frame and play table combination comprising;

a plurality of horizontally disposed, vertically registered platforms, the top platform of which serves as a child supporting top for said changing table in a first configuration, means for supporting said platforms in elevated, spaced-apart relation, said supporting means comprising a head board and a foot board in spaced-apart relation with said top platform disposed therebetween, said head board and said foot board being removable from said changing table to form a portion of said youth bed frame, and a lower table frame, said lower table frame being removable from said changing table to form a portion of said play table, said youth bed frame and said play table forming a second configuration, means for providing side walls for said platforms, said side walls being adapted to be coupled to the platforms and the first supporting means, mattress support rails for supporting a mattress, said mattress support rails being coupled to said headboard and footboard when said article is set up in said second configuration, and a table top for mounting on said lower table frame to complete said play table in said second configuration.

* * * * *